US008281971B2

(12) United States Patent
Wang et al.

(10) Patent No.: US 8,281,971 B2
(45) Date of Patent: Oct. 9, 2012

(54) LABOR-SAVING STAPLER

(75) Inventors: Rong-Yu Wang, Taichung Hsien (TW); Jing-Li Wang, Taichung Hsien (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 205 days.

(21) Appl. No.: 12/882,634

(22) Filed: Sep. 15, 2010

(65) Prior Publication Data

US 2012/0061444 A1 Mar. 15, 2012

(51) Int. Cl.
*B25C 5/02* (2006.01)

(52) U.S. Cl. ..... 227/134; 227/120

(58) Field of Classification Search ..... 227/120, 227/119, 127, 132, 134
See application file for complete search history.

(56) References Cited

U.S. PATENT DOCUMENTS 5,979,734 A * 11/1999 Chang ..... 227/76
6,494,356 B1 * 12/2002 Frank et al. ..... 227/127
6,925,849 B2 * 8/2005 Jairam ..... 72/476
7,021,515 B2 * 4/2006 Elonsson et al. ..... 227/134
7,431,186 B2 * 10/2008 Hsu ..... 227/120
7,661,571 B2 * 2/2010 Tsai ..... 227/134
7,748,589 B2 * 7/2010 Marks ..... 227/132
7,757,923 B2 * 7/2010 Huang et al. ..... 227/132
7,942,298 B2 * 5/2011 Kandasamy ..... 227/120
8,020,740 B2 * 9/2011 Wang ..... 227/134

* cited by examiner

*Primary Examiner* — Scott A. Smith

(74) *Attorney, Agent, or Firm* — Muncy, Geissler, Olds & Lowe, PLLC

(57) ABSTRACT

A labor-saving stapler of the present invention includes a base, a press arm, a transmission arm, a connection arm, a magazine, a staple pusher, a moving mechanism, a buckling mechanism and a switching mechanism. The magazine is slidably disposed between the connection arm and the base. The moving means moves the magazine outwardly when the switching mechanism is activated. As such, the magazine can be opened by operating the switching mechanism. When the switching mechanism includes a button or the same, users can open the magazine easily with only one hand.

9 Claims, 6 Drawing Sheets

LABOR-SAVING STAPLER

BACKGROUND OF THE INVENTION

1. Field of the Invention

The present invention relates to a stapler, and more particularly to a labor-saving stapler.

2. Description of the Prior Art

Some conventional staplers have a labor-saving mechanism. The labor-saving mechanism mainly includes a press arm and a transmission arm. The length of the press arm and the length of the transmission arm are predetermined for that the stapler can be driven by a small scale of force.

However, the press arm and the transmission arm have to be opened for loading the staples into the stapler. It is inconvenient that users have to open the press arm and the transmission arm with two hands.

The present invention is, therefore, arisen to obviate or at least mitigate the above mentioned disadvantages.

SUMMARY OF THE INVENTION

The main object of the present invention is to provide a stapler which is adapted for staples to be easily loaded therein.

To achieve the above and other objects, a labor-saving stapler of the present invention includes a base, a press arm, a transmission arm, a connection arm, a magazine, a staple pusher, a moving means, a buckling means and a switching means.

The base comprises a base plate and two side plates. The base plate has a front end and a rear end. The side plates are individually disposed on the base plate. The side plates extending upward are located on two opposite side of the rear end.

The press arm is pivotable about a first axle. The press arm is disposed on the base. The press arm has a pressing end located in front of the first axle and a resisting end located behind the first axle.

The transmission arm is pivotable about a second axle. The transmission arm is disposed between the press arm and the base. The transmission arm has a hitting end located in front of the second axle and a following end located behind the second axle. The following end and the resisting end are connected to each other.

The connection arm is disposed between the transmission arm and the base. The connection arm has a pivoting end. The pivoting end is pivotably connected to the side plates.

The magazine is slidably disposed between the connection arm and the base. A staple track is defined by the magazine. The staple track is adapted for staples to move therealong. The magazine is formed with a staple outlet corresponding to the front end of the base plate. The hitting end of the transmission arm is adapted for striking staples out via the staple outlet. The magazine has a hooking end corresponding to the rear end of the base plate.

The staple pusher is slidably disposed in the staple track so as to push staples forward.

The moving means is used to move the staple pusher toward the front end of the base plate.

The buckling means is used to make the hooking end of the magazine and the pivoting end of the connection arm in a buckling relationship.

The switching means is used to selectively lift the hooking end of the magazine and the pivoting end of the connection arm from the buckling relationship.

The moving means moves the staple pusher and the magazine toward the front end of the base plate simultaneously when the hooking end of the magazine and the pivoting end of the connection arm are lifted from the buckling relationship.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
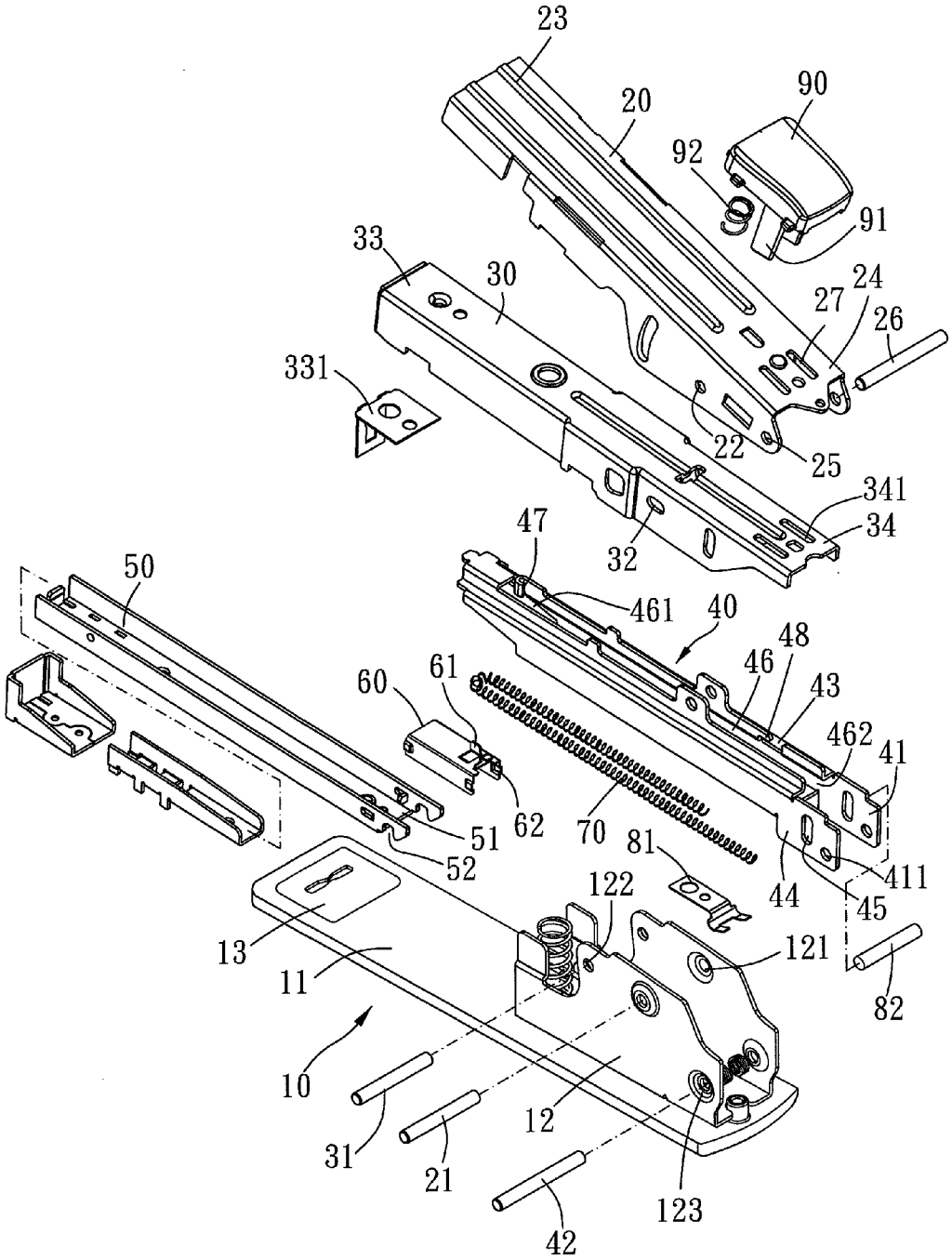
FIG. 1 is a breakdown drawing showing an embodiment of the present invention.
Figure 2:
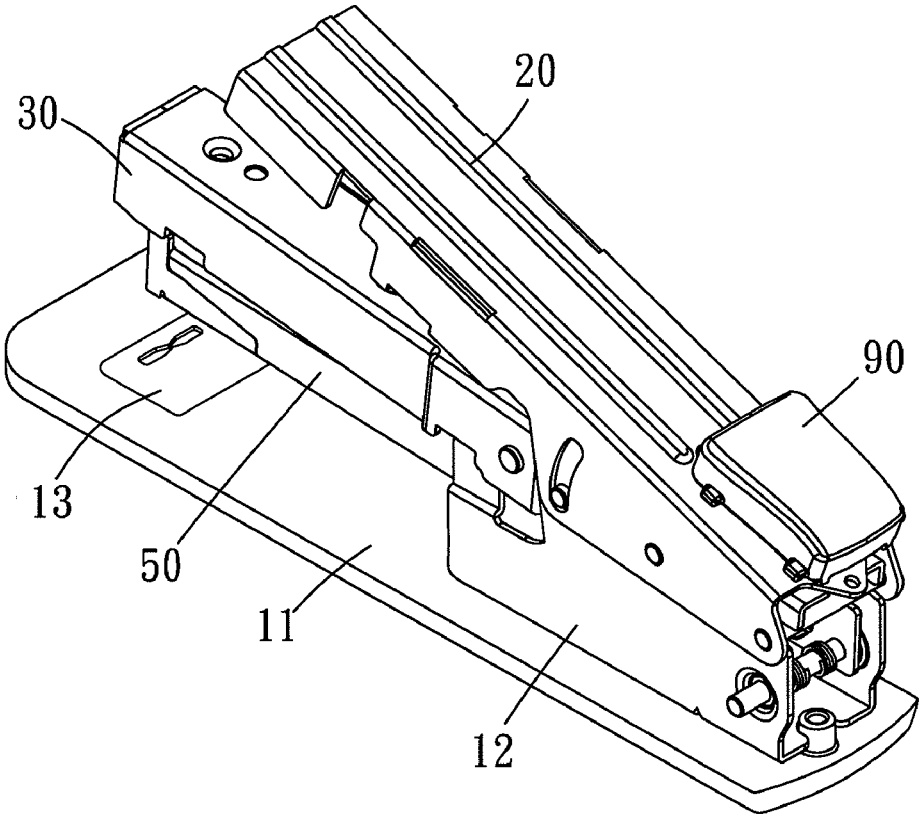
FIG. 2 is a stereogram showing an embodiment of the present invention.
Figure 3:
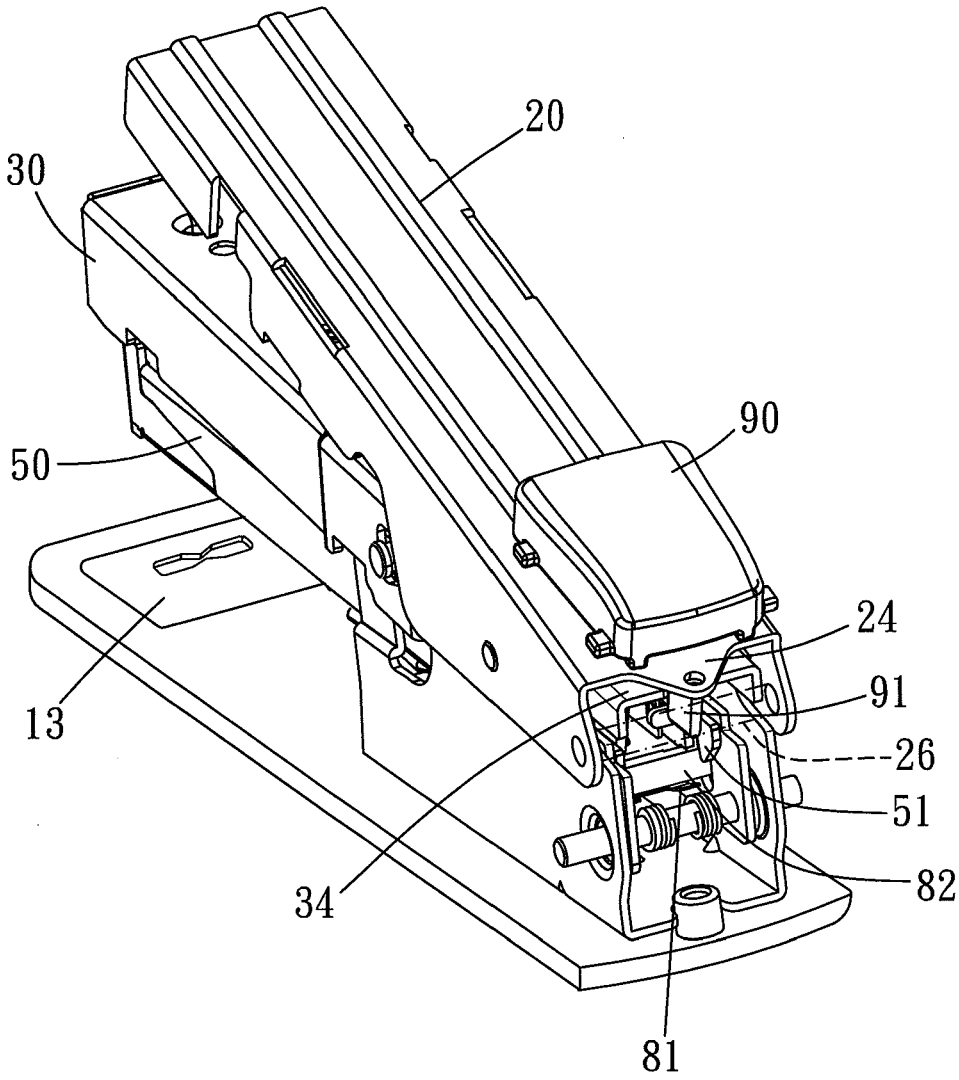
FIG. 3 is a stereogram of another viewpoint showing an embodiment of the present invention.

Please refer to FIG. 1 to FIG. 3. The labor-saving stapler of the present embodiment includes a base 10, a press arm 20, a transmission arm 30, a connection arm 40, a magazine 50, a staple pusher 60, a moving means, a buckling means and a switching means.

The base 10 includes a base plate 11 and two side plates 12. The base plate 11 has a front end and a rear end. An anvil 13 may be disposed on the front end of the base plate 11. The anvil 13 is adapted for blocking or bending a staple. The side plates 12 are individually disposed on the base plate 11. The side plates 12 extending upward are located on two opposite side of the rear end. Each side plate 12 is formed with a first axle hole 121, a second axle hole 122 and a pivoting hole 123.

The press arm 20 is able to pivot about a first axle 21. The press arm 20 is disposed on the base 10. More specifically, the press arm 20 has an axial hole 22. The first axle 21 is received in the axial hole 22 and the first axle holes 121. The press arm 20 has a pressing end 23 and a resisting end 24. The pressing end 23 is located in front of the first axle 21. The pressing end 23 is provided for users to press down. The resisting end 24 is located behind the first axle 21. The resisting end 24 is formed with a pair of lateral bores 25 and a pair of vertical inserting hole 27. The bores 25 are adapted for a resisting rod 26 to be inserted therein.

The transmission arm 30 is able to pivot about a second axle 31. The transmission arm 30 is disposed between the pressing arm 20 and the base 10. More specifically, the transmission arm 30 also has an axial hole 32. The second axle 31 is received in the axial hole 32 and the second axle holes 122. The transmission arm 30 has a hitting end 33 and a following end 34. The hitting end 33 is located in front of the second axle 31. A hitting plate 331 may be disposed on the hitting end 33, being adapted for hitting staples directly. The following end 34 is located behind the second axle 31. The following end 34 is formed with a pair of vertical inserting hole 341. The following end 34 is connected to the resisting end 24. More specifically, the following end 34 is located between the resisting end 24 and the resisting rod 26. The resisting rod 26 makes the following end 34 move upward together with the resisting rod 26 when the resisting end 24 moves upward.

For the purpose of labor-saving, a product of multiplying a length of the pressing end 23 by a length of the following end 34 may be greater than a product of multiplying a length of the resisting end 24 by a length of the hitting end 33.

The connection arm 40 is disposed between the transmission arm 30 and the base 10. The connection arm 40 has a pivoting end 41. The pivoting end 41 also has an axial hole 411. An axial rod 42 is received in the axial hole 411 and the pivoting holes 123, so that the pivoting end 41 is pivotably connected to the side plates 12. More specifically, the connection arm 40 has an upper plate 43 and two side plates 44. Each side plate 44 is formed with an axial hole 411. The side plates 44 are formed with a sliding groove unit 45. The sliding groove unit 45 is located on the pivoting end 41, more particularly in front of the axial hole 411. The upper plate 43 is formed with a guiding groove 46 extending vertically. The guiding groove 46 has a closing end 461 and an opening end 462. The closing end 461 is away from the pivoting end 41. The opening end 462 is close to the pivoting end 41. The upper plate 43 may has a returning pole 47 and a first fixation hook 48. The returning pole 47 extending upward is located close to the closing end 461. The first fixation hook 48 is located between the returning pole 47 and the opening end 462.

The magazine 50 is slidably disposed between the connection arm 40 and the base 10. A staple track is defined by the magazine 50, being adapted for staples to move therealong. The magazine 50 is formed with a staple outlet corresponding to the front end of the base plate 11. The hitting plate 331 located on the hitting end 33 of the transmission arm is adapted for striking staples out via the staple outlet, so that the staple should be bent by the anvil 13. The magazine 50 has a hooking end 51 corresponding to the rear end of the base plate 11. The hooking end 51 is formed with a hooking groove unit 52.

The staple pusher 60 is slidably disposed in the staple track. The staple pusher 60 is used to push staples forward. The staple pusher 60 has a protruding piece 61 and a second fixation hook 62. Both of the protruding piece 61 and the second fixation hook 62 extend upwardly. The protruding piece 61 is able to slide in the guiding groove 46. A sliding route of the protruding piece 61 is limited by the closing end 461 of the guiding groove 46.

The moving means is used to move the staple pusher toward the front end of the base plate 11. More specifically, the moving means includes an elastic member 70. The elastic member 70 is located between the staple pusher 60 and the connection arm 40. The elastic member 70 connects the staple pusher 60 to the connection arm 40. Preferably, the elastic member 70 is a tension spring. One end of the elastic member 70 is connected to the second fixation hook 62. The other end of the elastic member 70 goes around the returning pole 47 and is connected to the first fixation hook 48. As such, a smaller space for moving the staple pusher 60 is needed.

Figure 4:
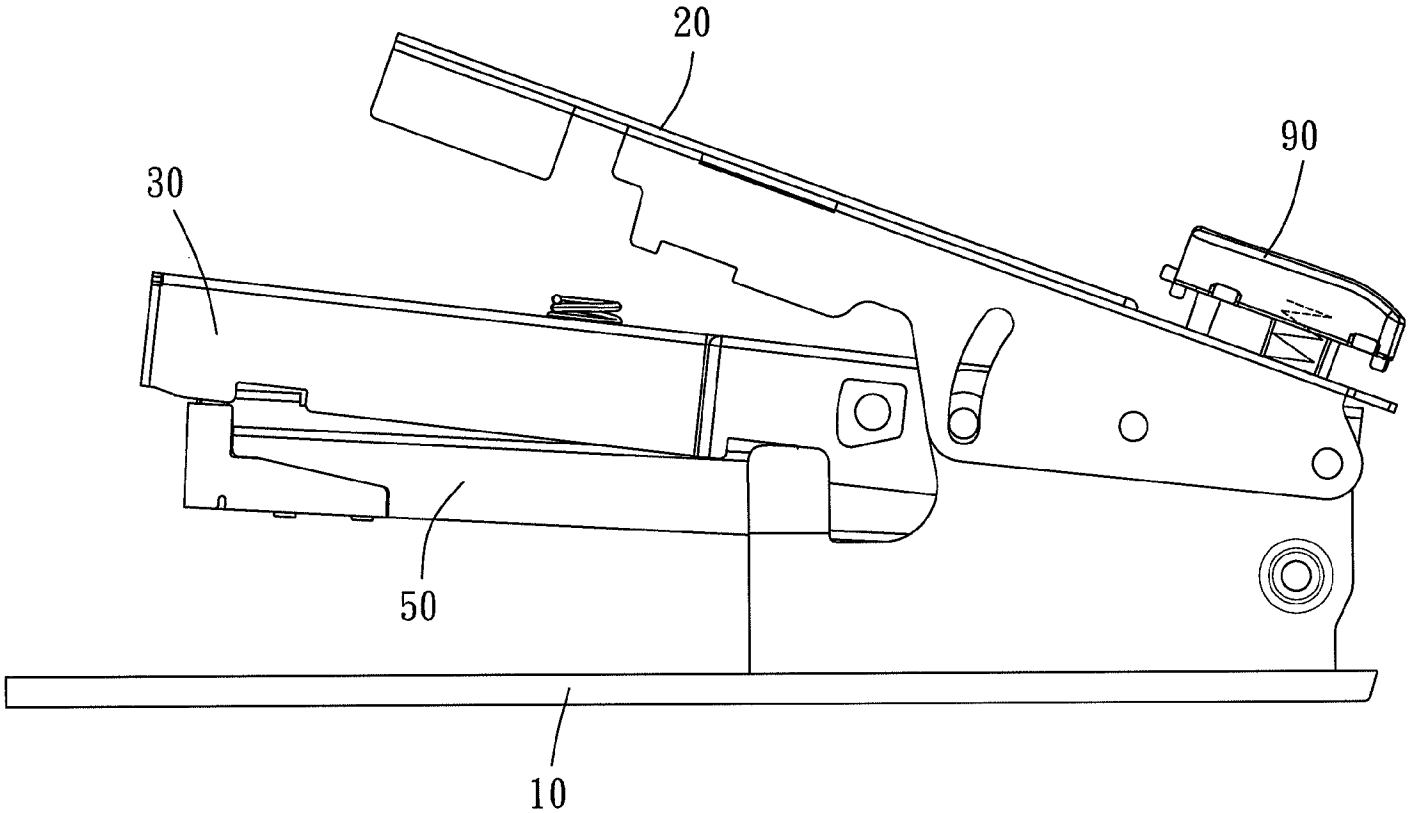
FIG. 4 is a side view showing an embodiment of the present invention.
Figure 5:
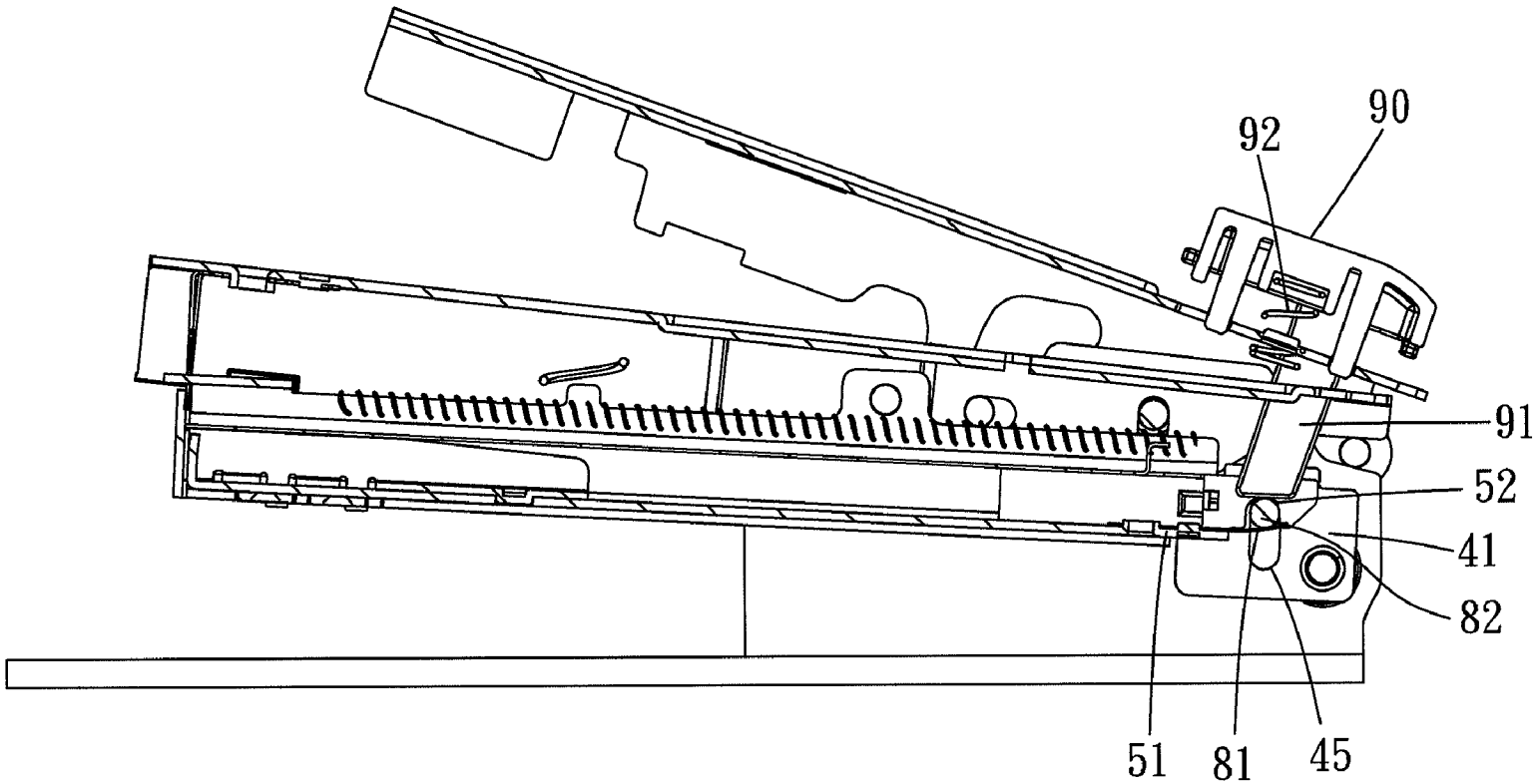
FIG. 5 is a profile showing an embodiment of the present invention.

Please refer to FIG. 4 and FIG. 5. The buckling means is used to make the hooking end 51 of the magazine and the pivoting end 41 of the connection arm in a buckling relationship. More specifically, the buckling means includes the hooking groove unit 52, the sliding groove unit 45, a flexible plate 81 and a sliding rod 82. The sliding rod 82 is slidably disposed in the sliding groove unit 45. One end of the flexible plate 81 is connected to the hooking end 51 of the magazine. The other end of the flexible plate 81 is adapted for pushing the sliding rod 82 so as to achieve the buckling relationship between the sliding rod 82 and the hooking groove unit 52.

The switching means is used to selectively lift the hooking end 51 of the magazine and the pivoting end 41 of the connection arm from the buckling relationship. Preferably, the switching means includes a button 90. The button 90 is disposed on the resisting end 24 of the press arm. The button 90 has a protruding arm 91 extending downward. The protruding arm 91 is received in the inserting holes 27 and 341. When the button 90 is pressed down, the protruding arm 91 make the sliding rod 82 move in the sliding groove unit 45, so that the sliding rod 82 and the hooking groove unit 52 are lifted from the buckling relationship. Preferably, a spring 92 is disposed between the button 90 and the press arm 20 so as to move the button to an initial position when the button is released from pressing.

Figure 6:
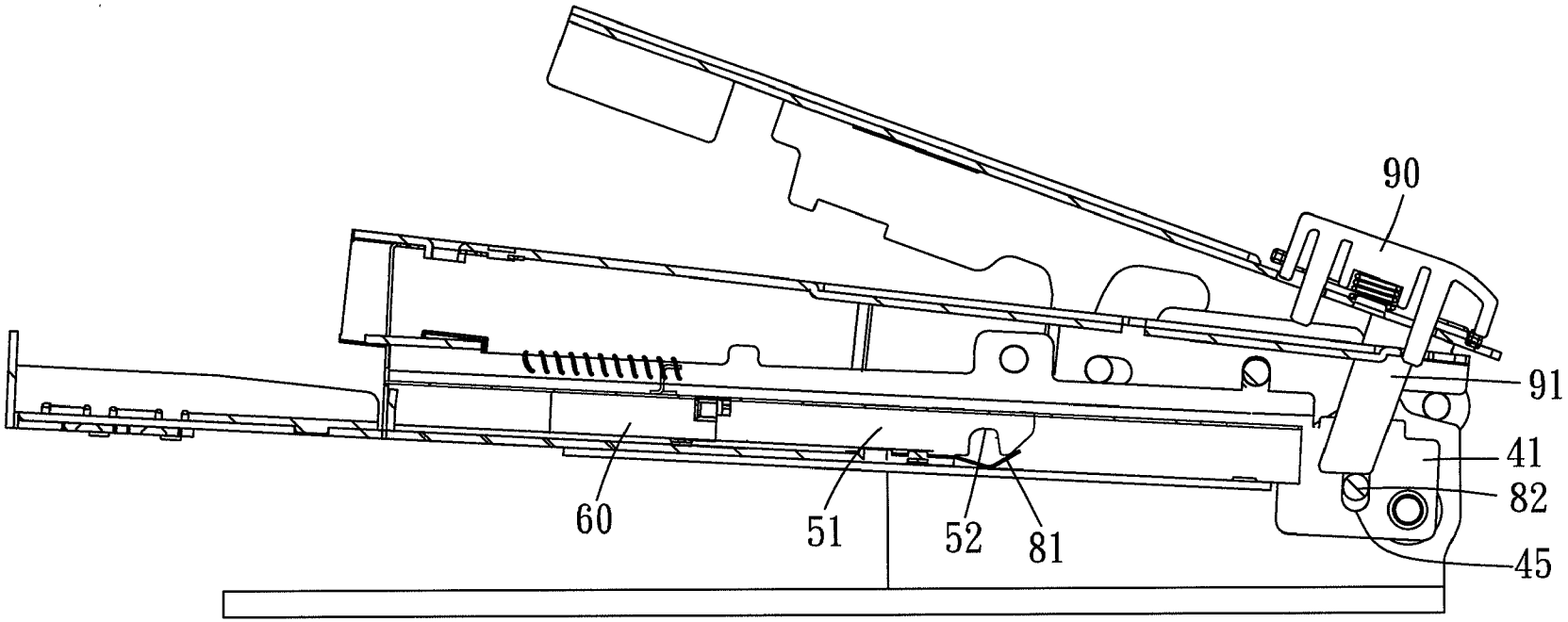
FIG. 6 is a profile showing an embodiment of the present invention, wherein the button is pressed.

When the button 90 is pressed down, as shown in FIG. 6, the hooking end 51 of the magazine and pivoting end 41 of the connection arm are lifted from the buckling relationship. The elastic member 70 can move the staple pusher 60 and the magazine 50 toward the front end of the base plate 11. As such, staples can be loaded into the labor-saving stapler by users.

Therefore, users can open the magazine by the switching means. The labor-saving stapler of the present invention can be easily operated by users with only one hand.

What is claimed is:

1. A labor-saving stapler, comprising:

a base, comprising a base plate and two side plates, the base plate having a front end and a rear end, the side plates being individually disposed on the base plate, the side plates extending upward being located on two opposite side of the rear end;

a press arm, being pivotable about a first axle, the press arm being disposed on the base, the press arm having a pressing end located in front of the first axle and a resisting end located behind the first axle;

a transmission arm, being pivotable about a second axle, the transmission arm being disposed between the press arm and the base, the transmission arm having a hitting end located in front of the second axle and a following end located behind the second axle, the following end and the resisting end being connected to each other;

a connection arm, being disposed between the transmission arm and the base, the connection arm having a pivoting end, the pivoting end being pivotably connected to the side plates;

a magazine, being slidably disposed between the connection arm and the base, a staple track being defined by the magazine, the staple track being adapted for staples to move therealong, the magazine being formed with a staple outlet corresponding to the front end of the base plate, the hitting end of the transmission arm being adapted for striking staples out via the staple outlet, the magazine having a hooking end corresponding to the rear end of the base plate;

a staple pusher, being slidably disposed in the staple track so as to push staples forward;

a moving means, being used to move the staple pusher toward the front end of the base plate;

a buckling means, being used to make the hooking end of the magazine and the pivoting end of the connection arm in a buckling relationship;

a switching means, being used to selectively lift the hooking end of the magazine and the pivoting end of the connection arm from the buckling relationship;

wherein the moving means moves the staple pusher and the magazine toward the front end of the base plate simultaneously when the hooking end of the magazine and the pivoting end of the connection arm are lifted from the buckling relationship.

2. The labor-saving stapler of claim 1, wherein the buckling means comprises a flexible plate, a hooking groove unit, a sliding groove unit and a sliding rod, the hooking end of the magazine is formed with the hooking groove unit, the pivoting end of the connection arm is formed with the sliding groove unit, the sliding rod is slidably disposed in the sliding groove unit, the flexible plate is adapted for pushing the sliding rod so as to achieve the buckling relationship between the sliding rod and the hooking groove unit.

3. The labor-saving stapler of claim 2, wherein the switching means comprises a button, the button is disposed on the resisting end of the press arm, the button has a protruding arm extending downward, the protruding arm makes the sliding rod and the hooking groove unit lift from the buckling relationship and pushes the sliding rod to slide in the sliding groove unit when the button is pressed down.

4. The labor-saving stapler of claim 3, wherein both of the resisting end of the press arm and the following end of the transmission arm are formed with an inserting hole, the inserting hole are adapted for the protruding arm to be received therein.

5. The labor-saving stapler of claim 3, wherein a spring is disposed between the button and the press arm so as to move the button to an initial position when the button is released from pressing.

6. The labor-saving stapler of claim 5, wherein the connection arm is formed with a guiding groove extending vertically, the staple pusher has a protruding piece extending upward, the protruding piece is able to slide in the guiding groove.

7. The labor-saving stapler of claim 1, wherein the moving means comprises an elastic member, the elastic member is located between the staple pusher and the connection arm, the elastic member connects the staple pusher to the connection arm.

8. The labor-saving stapler of claim 7, wherein the guiding groove has a closing end and an opening end, the closing end is located away from the pivoting end of the connection arm, the opening end is located close to the pivoting end of the connection arm, the connection arm has a returning pole and a first fixation hook, the returning pole is located close to the closing end, the first fixation hook is located between the returning pole and the opening end, the staple pusher has a second fixation hook extending upward, the elastic member is a tension spring, an end of the elastic member is connected to the second fixation hook, another end of the elastic member goes around the returning pole and is connected to the first fixation hook.

9. The labor-saving stapler of claim 1, wherein a product of multiplying a length of the pressing end by a length of the following end is greater than a product of multiplying a length of the resisting end by a length of the hitting end.

* * * * *